US006997342B2

(12) United States Patent
Mitchell et al.

(10) Patent No.: US 6,997,342 B2
(45) Date of Patent: Feb. 14, 2006

(54) DISPENSER FOR SHEET MATERIAL

(75) Inventors: Joseph Mitchell, Alpharetta, GA (US); Debra N. Welchel, Woodstock, GA (US); Herb F. Velazquez, Neenah, WI (US); Tim J. Morton, Chicago, IL (US); Joel G. Delman, Chicago, IL (US); Melanie L. Andres, Chicago, IL (US); John B Freese, Evanston, IL (US); Donna Ann Piacenza, Chicago, IL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 176 days.

(21) Appl. No.: 10/439,424

(22) Filed: May 16, 2003

(65) Prior Publication Data

US 2004/0245266 A1 Dec. 9, 2004

(51) Int. Cl.
*A47K 10/24* (2006.01)

(52) U.S. Cl. ..... 221/45; 221/282; 242/598.5

(58) Field of Classification Search ..... 221/45, 221/63, 282, 283; 242/595, 598.5, 594.1; 248/214, 311.2, 213.2; 206/494, 806, 409, 206/812, 233

See application file for complete search history.

(56) References Cited

U.S. PATENT DOCUMENTS

| | | | | |
|---|---|---|---|---|
| 2,122,048 | A | 6/1938 | Shapiro | |
| 2,765,909 | A | 10/1956 | Graham | |
| RE24,906 | E | 12/1960 | Ulrich | |
| 3,301,746 | A | 1/1967 | Sanford et al. | |
| 3,322,617 | A | 5/1967 | Osborne | |
| 3,612,264 | A | 10/1971 | Trunick | |
| 3,824,953 | A | 7/1974 | Boone | |
| 3,836,044 | A | 9/1974 | Tilp et al. | |
| 3,837,595 | A | 9/1974 | Boone | |
| 3,857,731 | A | 12/1974 | Merrill, Jr. et al. | |
| 3,921,802 | A | 11/1975 | Thompson | |
| 3,986,479 | A | 10/1976 | Bonk | |
| 3,995,582 | A | 12/1976 | Douglas | |
| 4,106,616 | A | 8/1978 | Boone | |
| 4,106,617 | A | 8/1978 | Boone | |
| 4,190,321 | A | 2/1980 | Dorer et al. | |
| 4,235,333 | A | 11/1980 | Boone | |
| 4,610,357 | A | 9/1986 | Nakamura | |
| 4,620,502 | A | 11/1986 | Kimble | |
| 4,638,921 | A | 1/1987 | Sigl et al. | |
| 4,651,874 | A | 3/1987 | Nakamura | |
| 4,653,250 | A | 3/1987 | Nakamura | |
| 4,739,879 | A * | 4/1988 | Nakamura | 206/205 |
| 4,741,944 | A | 5/1988 | Jackson et al. | |
| 4,834,316 | A | 5/1989 | DeLorean | |

(Continued)

FOREIGN PATENT DOCUMENTS

| | | |
|---|---|---|
| CA | 2305110 | 10/2001 |

(Continued)

*Primary Examiner*—Kenneth Noland
(74) *Attorney, Agent, or Firm*—Sue C. Watson

(57) ABSTRACT

A dispenser adapted for dispensing from a table top and convertible to dispensing from a conventional rolled product fixture is provided. The dispenser has a housing having a compartment configured to hold sheets therein and a dispensing opening. The housing is configured to be positioned on a table top for dispensing sheets therefrom. The housing including arms which permit the housing to be coupled to a fixture. The arms are masked when the dispenser is positioned for dispensing from a table top. The arms are readily releasable to permit the housing to be releasably coupled to a fixture in a bathroom.

35 Claims, 7 Drawing Sheets

U.S. PATENT DOCUMENTS

| | | | | |
|---|---|---|---|---|
| 4,865,221 | A | | 9/1989 | Jackson et al. |
| 4,913,312 | A | | 4/1990 | Boutin |
| 5,048,589 | A | | 9/1991 | Cook et al. |
| 5,194,299 | A | | 3/1993 | Fry |
| 5,265,758 | A | | 11/1993 | Saint Criq et al. |
| 5,311,986 | A | * | 5/1994 | Putz ..... 206/233 |
| 5,399,412 | A | | 3/1995 | Sudall et al. |
| 5,409,181 | A | | 4/1995 | Patrick |
| 5,439,521 | A | | 8/1995 | Rao |
| 5,607,551 | A | | 3/1997 | Farrington, Jr. et al. |
| 5,618,008 | A | | 4/1997 | Dearwester et al. |
| 5,620,148 | A | | 4/1997 | Mitchell |
| 5,629,081 | A | | 5/1997 | Richards et al. |
| 5,656,361 | A | | 8/1997 | Vogt et al. |
| 5,660,636 | A | | 8/1997 | Shangold et al. |
| 5,672,248 | A | | 9/1997 | Wendt et al. |
| 5,765,717 | A | | 6/1998 | Gottselig |
| 5,897,074 | A | | 4/1999 | Marino |
| 5,950,960 | A | * | 9/1999 | Marino ..... 242/594.5 |
| 5,951,762 | A | | 9/1999 | Shangold et al. |
| 5,964,351 | A | | 10/1999 | Zander |
| 6,047,920 | A | | 4/2000 | Dearwester et al. |
| 6,056,235 | A | | 5/2000 | Brozinsky |
| 6,098,836 | A | | 8/2000 | Gottselig |
| 6,098,919 | A | | 8/2000 | Lewis |
| 6,170,698 | B1 | | 1/2001 | Phelps et al. |
| 6,230,929 | B1 | | 5/2001 | Phelps et al. |
| 6,328,252 | B1 | | 12/2001 | Neveu et al. |
| 6,346,153 | B1 | | 2/2002 | Lake et al. |
| 6,382,552 | B1 | | 5/2002 | Paul et al. |
| 6,439,384 | B1 | | 8/2002 | Sauer et al. |
| 6,439,386 | B1 | | 8/2002 | Sauer et al. |
| 2002/0063136 | A1 | | 5/2002 | Sauer et al. |
| 2002/0092789 | A1 | | 7/2002 | Sauer et al. |
| 2003/0075551 | A1 | | 4/2003 | Dailey, III |
| 2003/0192903 | A1 | | 10/2003 | Sauer et al. |

FOREIGN PATENT DOCUMENTS

| | | |
|---|---|---|
| EP | 0459110 | 12/1991 |
| EP | 0568987 | 7/1997 |
| EP | 1129656 A1 | 9/2001 |
| GB | 2270901 | 3/1994 |
| WO | 94/14365 | 7/1994 |
| WO | 98/04486 | 2/1998 |
| WO | 00/65973 | 11/2000 |
| WO | 01/76436 | 10/2001 |
| WO | 01/76440 | 10/2001 |
| WO | WO 01/76439 | 10/2001 |
| WO | 1/89935 | 11/2001 |
| WO | 02/21988 | 3/2002 |
| WO | 02/21989 | 3/2002 |

* cited by examiner

DISPENSER FOR SHEET MATERIAL

BACKGROUND

This use of single sheets provided as interfolded dry sheets for facial tissue and bath tissue has been widely accepted. Such single sheets often provide less waste than traditional rolled bath tissue. Similarly, the use of premoistened or "wet" sheets has gained wide acceptance for a variety of uses, including bathroom applications. Dry sheets and premoistened sheets are generally formed from an absorbent material such as a paper or polymeric web, or combinations thereof, and may contain a disinfectant, medicant, deodorant, anti-microbial, anti-bacterial, cleansing agent, and so forth, in one or more combinations, on a dry sheet or in a "wet" formulation on a premoistened sheet. Premoistened sheets are generally stored and dispensed from a sealable container or dispenser to prevent the sheets from drying out.

Various dispenser or container designs for dry sheets as well as premoistened sheets have been developed for table top dispensing. In addition, various dispenser designs for dry and/or premoistened sheets have been used with existing bathroom fixtures, such as fixtures for conventional rolled products. These dispensers for table top use were not adaptable for use with bath fixtures. Similarly, dispensers for use with bathroom fixtures were not designed for a table top use. In addition, dispensers for use with bath fixtures have often been cumbersome and bulky, and they have also been problematic with regard to space and mounting considerations. Further, refilling such dispensers has also been difficult.

Accordingly, it would be desirable to provide a dispenser capable of dispensing dry and/or premoistened sheets which is adaptable aesthetically for table top dispensing as well as for dispensing from a conventional rolled product fixture, such as a rolled bath tissue fixture. Such a dispenser would easily convert from a table top dispenser to a dispenser which easily and releasably couples to such a fixture. In addition, it would be desirable to provide a dispenser that is adapted for use in dispensing dry sheets, or a combination of dry sheets and premoistened sheets, from a conventional rolled product fixture. Further, it would be desirable to provide such a dispenser as a non-refillable, disposal dispenser.

Definitions

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

These terms may be defined with additional language in the remaining portions of the specification.

SUMMARY OF THE INVENTION

A dispenser adapted for dispensing from a table top and convertible to dispensing from a conventional rolled product fixture is provided. The dispenser has a housing having a compartment configured to hold sheets therein and a dispensing opening. The housing is configured to be positioned on a table top for dispensing sheets therefrom. The housing including arms which permit the housing to be coupled to a fixture. The arms are masked when the dispenser is positioned for dispensing from a table top. The arms are readily releasable to permit the housing to be releasably coupled to a fixture in a bathroom.

DETAILED DESCRIPTION

Figure 1:
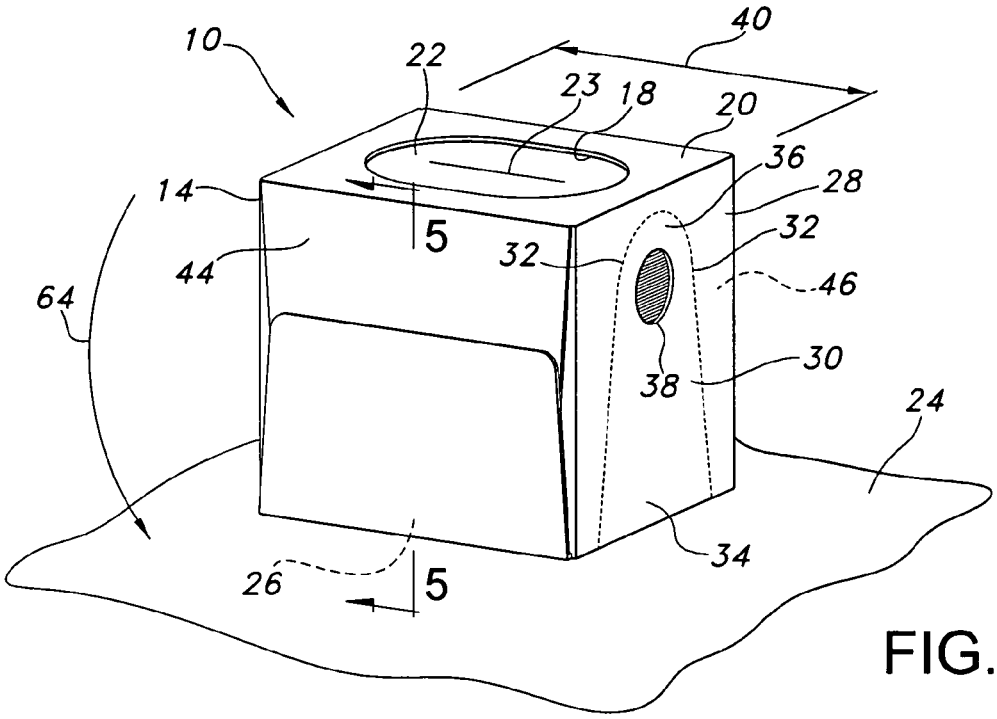
FIG. 1 is a perspective view of an embodiment of the dispenser of the present invention, illustrating the dispenser's dispensing position on a generally horizontal surface for dispensing dry sheets.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1–16, in general, a dispenser is provided for storing and dispensing sheets. It should be appreciated that the present invention is not limited to any particular type of sheets. The dispenser, however, is well suited for dispensing individual stacked interfolded sheets, as generally illustrated in the figures. Non-limiting examples of dry sheets are disclosed in U.S. Pat. No. 3,301,746 to Sanford et al., U.S. Pat. No. 3,322,617 to Osborne, U.S. Pat. No. 5,048,589 to Cook et al., U.S. Pat. No. 5,399,412 to Sudall et al., U.S. Pat. No. 5,607,551 to Farrington et al., and U.S. Pat. No. 5,672,248 to Wendt et al., all of which are incorporated by reference herein in their entirety. Non-limiting examples of premoistened sheets are disclosed in U.S. Pat. Nos. 4,741,944 and 4,865,221, both to Jackson etc. al., U.S. Pat. No. 5,629,081 to Richards et al., U.S. Pat. No. 5,656,361 to Vogt et al., and U.S. Pat. No. 5,964,351 to Zander, all of which are incorporated by reference in their entirety herein. Such stacked, interfolded and/or festooned configurations for dry sheets, such as toilet tissue, and/or premoistened sheets are well known to those of ordinary skill in the art and need not be described in great detail herein.

Figure 2:
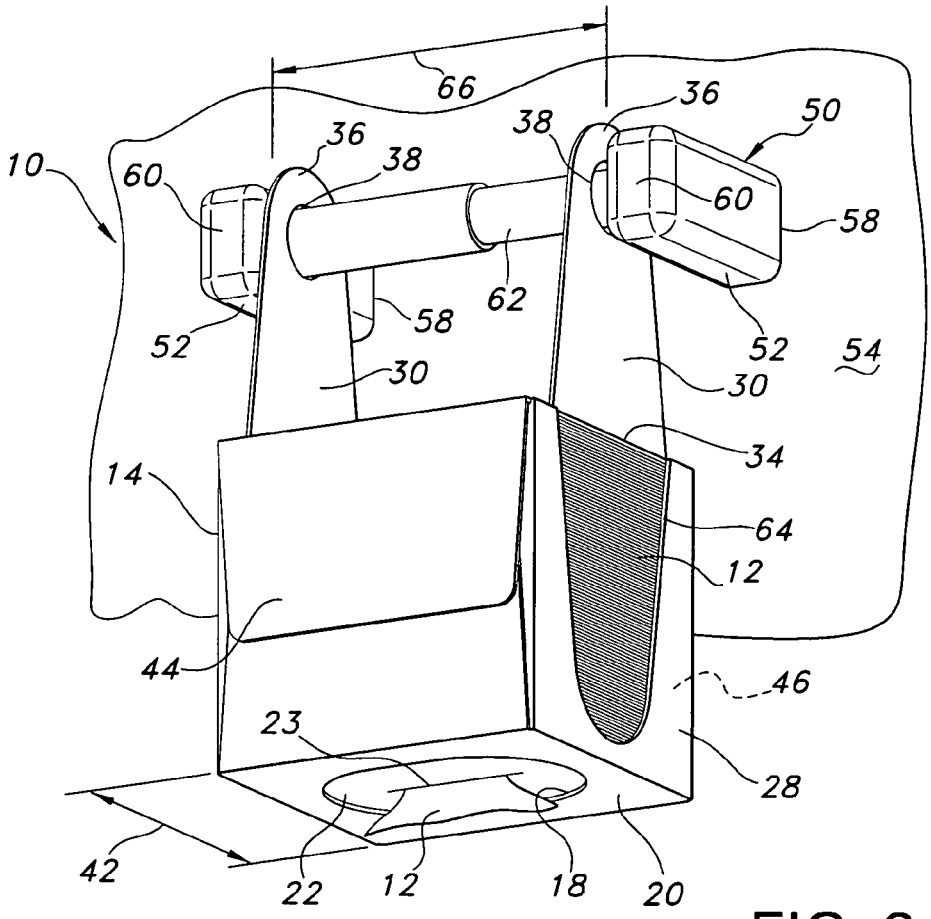
FIG. 2 is a perspective view of the dispenser of FIG. 1, but showing the dispenser in it's dispensing position for dispensing dry sheets from a conventional rolled product fixture.
Figure 5:
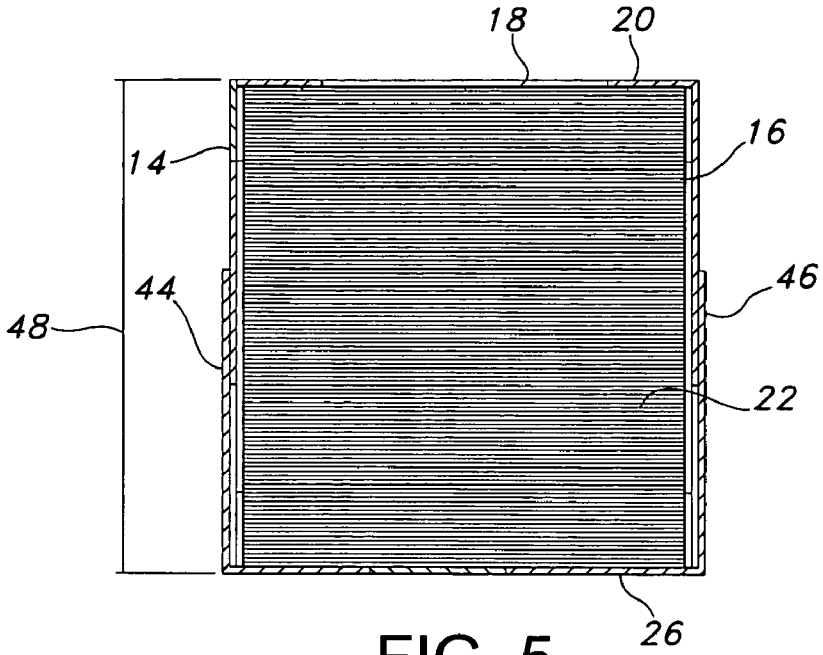
FIG. 5 is a sectional view of FIG. 1 taken along line 5—5.

As illustrated in FIGS. 1, 2, and 5, a dispenser 10 according to the invention is provided for dispensing dry sheets 12. The dispenser 10 includes a housing 14 which has a compartment 16 from which dry sheets are stored and dispensed. A dispensing opening 18 is defined in the housing 14 to permit access to the compartment 16 and the dry sheets 12 therein. The dispensing opening 18 desirably is provided by way of non-limiting example, at a first end 20 of the housing 14. One or more dispensing openings may be provided, however, in any wall, and surface, and any combinations thereof in any housing shown and/or described herein, to dispense any type of sheet described and/or shown herein. It will be appreciated that any dispensing opening herein may take any suitable shape or configuration. Any dispensing opening shown or described herein may be covered, for example, but not by way of limitation, by a plastic film 22, having a slit 23 therein, and so forth. One or more dispensing openinsg may be formed from perforated portions that, when removed, provide the opening(s) (not shown), and so forth.

When the dispenser 10 is used to dispense dry sheets 12 from a generally horizontal surface 24, such as a table top, the dispenser 10 is positioned such that the first end 20 of the housing 14 is disposed in a superior or higher position and a second end 26 of the housing 14 is disposed in an inferior or lower position. This position is sufficient for dispensing dry sheets 12 for use, for example, as facial tissue sheets, and so forth. However, as often occurs in a bathroom, it is desirable to have a dispenser which is suitable for dispensing sheets for use as bath or toilet tissue. The dispenser 10 easily adapts to this task, converting from a table top dispenser to a dispenser which couples to a conventional rolled product fixture for dispensing sheets for use as bath or toilet tissue.

To this end, the housing includes a pair of spaced-apart side walls 28 which each include an arm 30. In the present embodiment, the arms 30 are provided as a portion of each side wall 28 and are formed by perforations or perforated areas 32 provided in each side wall 28. When the perforated areas 32 are separated and disconnected from the side walls 28 to release the arms 30, the arms 30 are positionable away from the side walls 28, as generally illustrated in FIG. 2. The perforated areas 32 permit the arms 30 to be masked as a portion of the sidewalls 28. That is, the arms 30 are "hidden" in the plain view of a user prior to their disconnection.

In a released position, each of the arms 30 includes a connected end 34 coupled to or formed within the side wall 28 or a portion of the housing 14, and an opposite free end 36. An aperture 38 is formed in a portion of each free end 36.

Referring to FIGS. 1 and 2, the housing 14 has a configuration with a width dimension 40 (FIG. 1) between opposing sidewalls 28, a depth dimension 42 (FIG. 2) between a front wall 44 and a back wall 46 and a length dimension 48 between first and second ends 20,26 (FIG. 5) so as to be supported by a conventional rolled product fixture 50 designed to hold rolled toilet tissue. Such fixtures are well known and a typical fixture 50 is illustrated in FIG. 2 as having a pair of transversely extending side support members 52. Such side support members 52 are mounted to and extending transversely from a generally vertically disposed support surface 54. Alternatively, the side support members 52 extend from a base or back member (not shown) which is affixed to the generally vertically disposed support surface. As shown in FIG. 2, each of the support members 52 has a length which extends from a coupled end 58 to a free end 60 of the support member 52. A divot or recess (not shown) is typically provided near each free end 60. A roll mount 62, in the present embodiment, a conventional spindle, is also provided. Such a roll mount 62 has connecting or protruding members on each end (not shown) such that when the roll mount 62 is inserted through a hollow core of a rolled product, the protruding members (not shown) are received in the recesses of the support members 52.

To releasably couple the dispenser 10 to a fixture 50, the arms 30 are released and the dispenser 10 is turned 180 degrees in a direction 64 such that the first end 20 of the housing 14 is positioned in an inferior or lower position relative to the second end 26 of the housing 14, which is positioned in a superior or higher position. The roll mount 62 is received through the aperture 38 in each free end 36 of each arm 30. The roll mount 62 is then releasably coupled to the fixture 50 by disposing the protruding members (not shown) on the roll mount 62 into the recesses (not shown) provided by the support members 52, thereby positioning the dispenser 10 in the dispensing position for dispensing dry sheets 12. The dry sheets 12 are dispensed from the now lowest end of the dispenser. As used herein, the term "roll mount" includes a spindle; it also includes a pair of prongs mounted on each support member or side portion of a fixture, such as may be used with a coreless bath tissue roll, illustrated and described in detail in U.S. Pat. No. 5,620,148 to J. P. Mitchell, which is hereby incorporated by reference herein it's entirety.

The arms 30, when released to couple the dispenser 10 to the fixture 50, create openings 64 which reveal the dry sheets 12 contained within the housing 14. These openings 64 are configured to provide a visual determination of the amount of dry sheets 12 available in the compartment 16 of the housing 14. The openings 64 also provide an indication of when the dispenser 10 has few remaining dry sheets 12 available for use.

In this regard, the housing 14 and any housing herein may be a refillable, or it may be a non-refillable housing 14 which is disposed of when empty. The housing 14 and any housing herein may be formed from any conventional material, such as, by way of non-limiting example, metal, plastic, wood, and so forth. The housing 14 and any housing herein may also be made of a relatively inexpensive cardboard, paperboard, plastic, polymer film, cellophane, and any combinations thereof, and so forth. The housing 14 and any housing herein may have a separate sidewall (not shown) which is fastened by fasteners, hinged, latched and/or or otherwise coupled thereto when it is refillable to permit refilling of the dispenser 10 (not shown).

It will be appreciated that the housing 14 and the dispenser 10, or any housing and dispenser herein, may take on any configuration; however, a generally polygonal shape may be desirable. The generally boxed-shaped configuration of the present embodiment, however, is for non-limiting illustrative purposes only, and it will be appreciated that any configuration may be used in providing the housing 14.

The dispenser 10, being adapted to couple to a conventional rolled product fixture 50, and has a housing 14 having dimensions that are compatible generally with the width dimension 66 between the support members 52 and the fixture 50. Such dimensions provide a dispenser 10 that is aesthetically and functionally configured to provide a compatibly sized appurtenance relative to both table top dispensing and dispensing from the fixture 50. Such a dispenser 10 is configured so that it is neither too small to be functionally efficient nor to heavy, large and/or ponderous to be aesthetically unpleasant. Either extreme would provide a dispenser 10 which would be functionally and/or aesthetically disproportionate relative to table top dispensing and dispensing from the fixture. Therefore, the housing 14 desirably has a width dimension 40 in a range of about 6.0 inches to about 3.5 inches. Even more desirably, the housing 14 has a width dimension 40 in a range of about 5.75 inches to about 3.75 inches. Yet even more desirably, the housing 14 has a width dimension 40 in a range of about 5.75 inches to about 4.0 inches. Similarly, to achieve the appearance of compatibility with the fixture 50, the housing 14 desirably has a length dimension 42 in a range of about 3 inches to about 6 inches. Further, the housing 14 desirably has a length dimension 42 in a range of about 3 inches to at least 8 inches.

Figure 3:
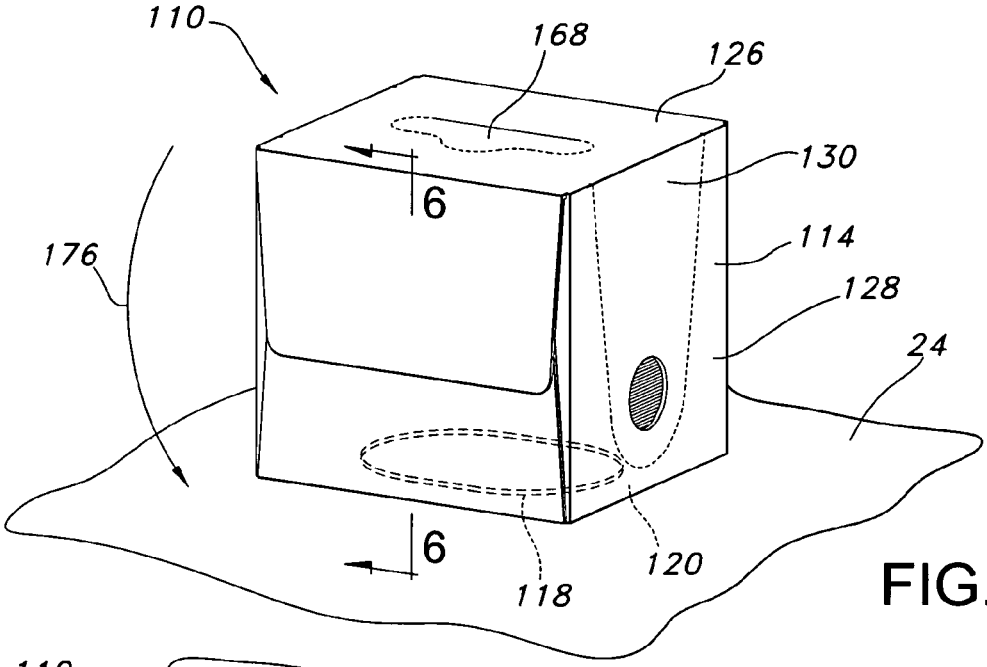
FIG. 3 is a perspective view of another embodiment of the dispenser of the present invention, illustrating the dispenser's dispensing position on a generally horizontal surface for dispensing both premoistened sheets from one end and dry sheets from an opposite end when the dispenser is turned 180 degrees.
Figure 4:
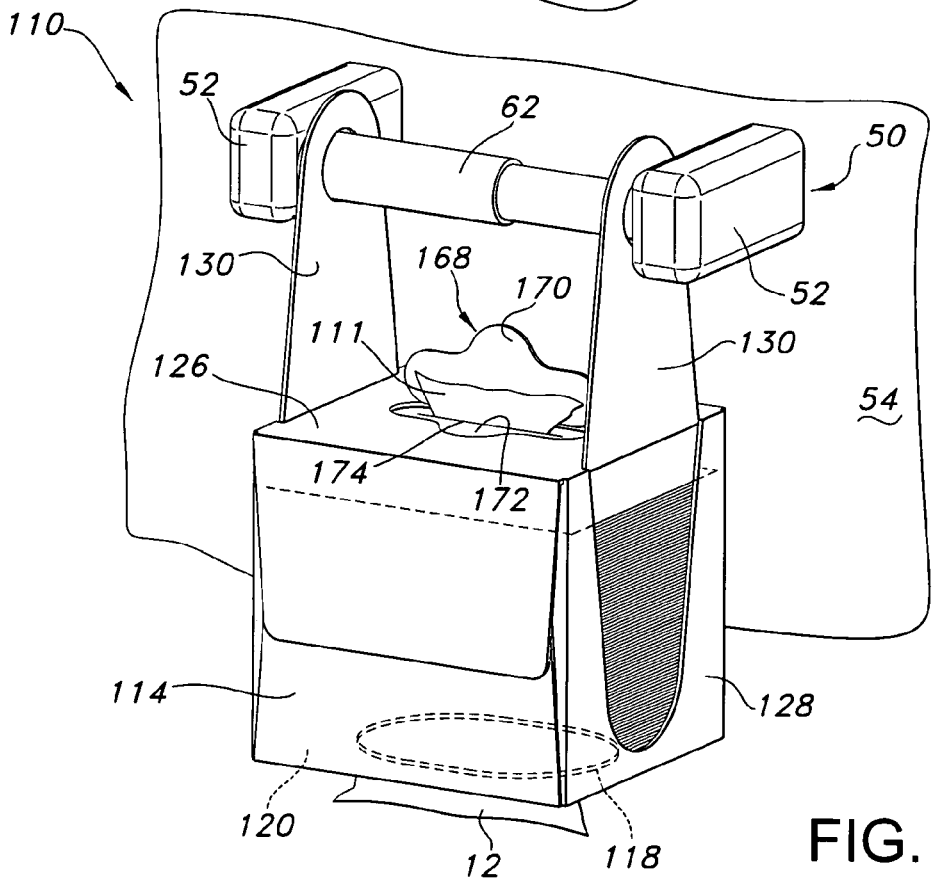
FIG. 4 is a perspective view of the dispenser of FIG. 3 in it's dispensing position for dispensing premoistened sheets from one end and dry sheets from an opposite end when coupled to a conventional rolled product fixture.
Figure 6:
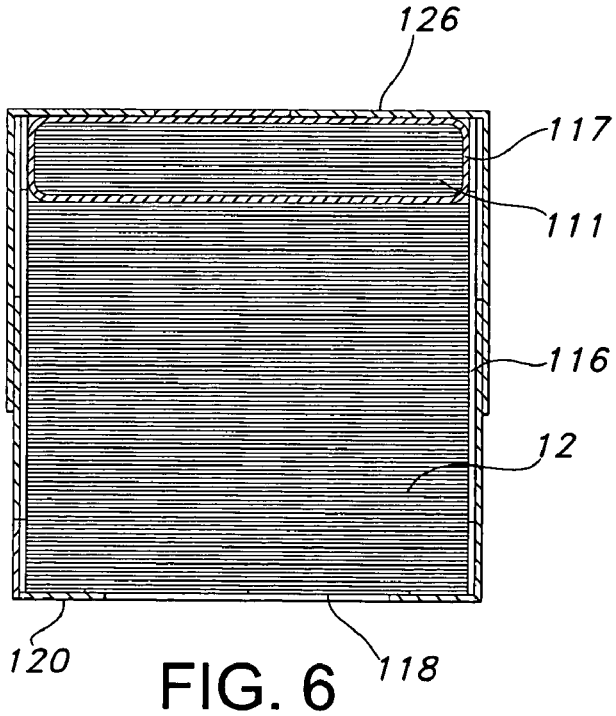
FIG. 6 is a sectional view of FIG. 3 taken along line 6—6.

In another embodiment of the invention, as illustrated in FIGS. 3, 4 and 6, the dispenser 110 and housing 114 are similar to the dispenser 10 and housing 14 shown in FIGS. 1, 2 and 5 and previously described in detail herein. The dispenser 110, however, is adapted to provide premoistened sheets 111 as well as dry sheets 12 in a single housing unit 114. The housing 114 includes a compartment 116 which contains dry sheets 12, and a container 117 of premoistened sheets 111. The premoistened sheets 111 are dispensed from the container 117 and housing 114, and the dry sheets 12 are dispensed from the first compartment of the housing, as shown in FIG. 4. The housing 114 may include another compartment formed by an inner wall (not shown) from which premoistened sheets 111 in the container 117 are dispensed (not shown).

A first dispensing opening 118 is defined in the housing 114 to permit access to the dry sheets 12 contained therein. The first dispensing opening 118 is desirably provided, by way of non-limiting example, in the first end 120. A second dispensing opening (not shown) is also defined in the housing 114 to permit access and dispensing of the premoistened sheets 111. The second dispensing opening desirably is provided, by way of non-limiting example, on the second end 126 of the housing. The container 117 of premoistened sheets 111 is exposed through the second dispensing opening 121, which provides access thereto. The container 117 also includes an opening (not shown) which is desirably aligned with the second dispensing opening (not shown) to permit access to and dispensing of the premoistened sheets 111. It will be appreciated that any dispensing opening shown and/or described herein may take on any suitable shape or configuration.

As shown in FIGS. 3 and 4, a resealable cover 168 is positioned over the second dispensing opening (not shown) in the housing 114, and it permits access to the premoistened sheets 111 in the container 117. Alternatively, or, in addition thereto, the container 117 for the premoistened sheets 111 may include a resealable cover 168 which is positioned on a surface of the container 117 adjacent a second end 126 of the housing 114 to permit access to the premoistened sheets 111 through an opening in the container 117.

The resealable cover 168 is used to maintain the moisture conditions within the housing 114 and/or container 117 and to prevent undesired drying out of the premoistened sheets 111. The resealable cover 168 includes an upper flap 170 which is coupled to a portion of a lower flap 172, which has a slit or opening 174 therein through which the premoistened sheets 111 are withdrawn. The resealable cover 168 is positioned over the second dispensing opening (not shown) in the housing 114, an opening in the container 117 (not shown), or both. The upper flap 170 resealably engages the lower flap 172 to provide a resealable closure to the housing 114 and the container 117. Such releasable and resealable features between the upper and lower flaps 170, 172 is provided, by way of non-limiting example, by an adhesive, such as a pressure sensitive adhesive, a cohesive adhesive, such as a latex or other natural rubber material, and so forth. The present resealable cover is presented herein by way of example, and not by way of limitation. Other resealable mechanisms, such as, by way of non-limiting example, snap-fit, hinge cover and lid, and so forth are known, and any commercially available resealable mechanism may be used with the housing and/or the container.

The housing 114 is desirably a non-refillable housing 114 which is disposed of when all of the sheets 111, 112 are removed. The housing 114 may be formed from any materials as previously described herein, or as known to those skilled in the art. Alternatively, the housing 114 has a separate sidewall which is fastened, latched, hinged or otherwise coupled thereto to permit refilling (not shown).

As illustrated in FIGS. 3, 4 and 6, the housing 114 desirably is an integral unit such that the compartment 116 contains both the container 117 of premoistened sheets 111 and the dry sheets 12. However, the housing 114 and any housing herein may include first and second compartments (not shown) formed separately, but which are bonded or coupled together, by way of heat sealing, adhesively sealing, ultrasonically sealing, stapling, taping, shrink-wrapping, and so forth, in which one compartment includes dry sheets, and another compartment includes premoistened sheets (not shown). In this instance, it may be desirable to form at least a portion of the housing 114 or a compartment 116 from a liquid impermeable material so as to properly contain the premoistened sheets. However, portions of the housing may be formed partially or entirely of any type of material, or any combination of materials, including, but not limited to, a liquid absorbent or a liquid impermeable material. For example, the premoistened sheets may be encased in a liquid impermeable film, and this film may provide a portion, or all of the container 117 as illustrated in FIGS. 4 and 6, and/or a compartment 116 in the housing 114. In a further example, one or more compartments in the housing 114 may be lined with film (not shown). The premoistened sheets 111 may be provided in the container 117 which is lined with the film. The container 117 is preferably coupled to a portion of the housing 114, for example but not by way of limitation, the second end 126 of the housing 114. Such coupling may be obtained by adhesive, heat sealing, ultrasonic bonding, and so forth.

It will be understood that the position of the premoistened sheets 111 and the dry sheets 12 within the housing 114 is such that either may be reversed in position, need not be in a stacked configuration. They may take on any suitable arrangement, including a side-by-side arrangement, a coaxial arrangement, and so forth. Any number of configurations may be used for simultaneously dispensing dry and/or premoistened sheets from a single housing. In addition, any dispenser and housing herein may use any structure, feature and/or characteristic shown and/or described herein. All such configurations are within scope and spirit of the present invention.

In a first dispensing position, the dispenser 110 is provided such that the arms 130 remain positioned as a portion of the sidewalls 128, as illustrated in FIG. 3 when the dispenser 110 is positioned on a generally horizontal surface 24 to dispense sheets, that is, either premoistened sheets 111 or dry sheets 12 for facial use and so forth.

When the dispenser 110 is disposed in a generally horizontal surface to dispense sheets, it will be appreciated that the dispenser 110 in one position, as shown in FIG. 3, dispenses premoistened sheets 111, and when rotated 180 degrees in a direction 176, the dispenser 110 dispenses dry sheets 12. Such positioning of the dry sheets 12 and premoistened sheets 111 in the housing 114 is non-limiting, and it will be appreciated as illustrated below that both dry sheets 12 and premoistened sheets 111 may be positioned in the dispenser 110 such that both types of sheets are available for use without the need to move or rotate the dispenser 110.

When the dispenser is utilized with a conventional rolled product fixture 50, the arms 30 are released and positioned on the roll mount 62 as previously described herein, and illustrated in FIGS. 2 and 4. In this position, the dry sheets 12 are dispensed from the first end 120, which is positioned in an inverted, inferior or lower position, and the premoistened sheets 111 are dispensed from the second end 126, which is positioned in an upper, higher or superior position relative to the first end 120. The dispensing arrangement is non-limiting, and for illustrative purposes only. It will be appreciated that the dispenser 110 may be adapted to dispense either type of sheet from any end, wall, surface, or combination thereof.

Figure 7:
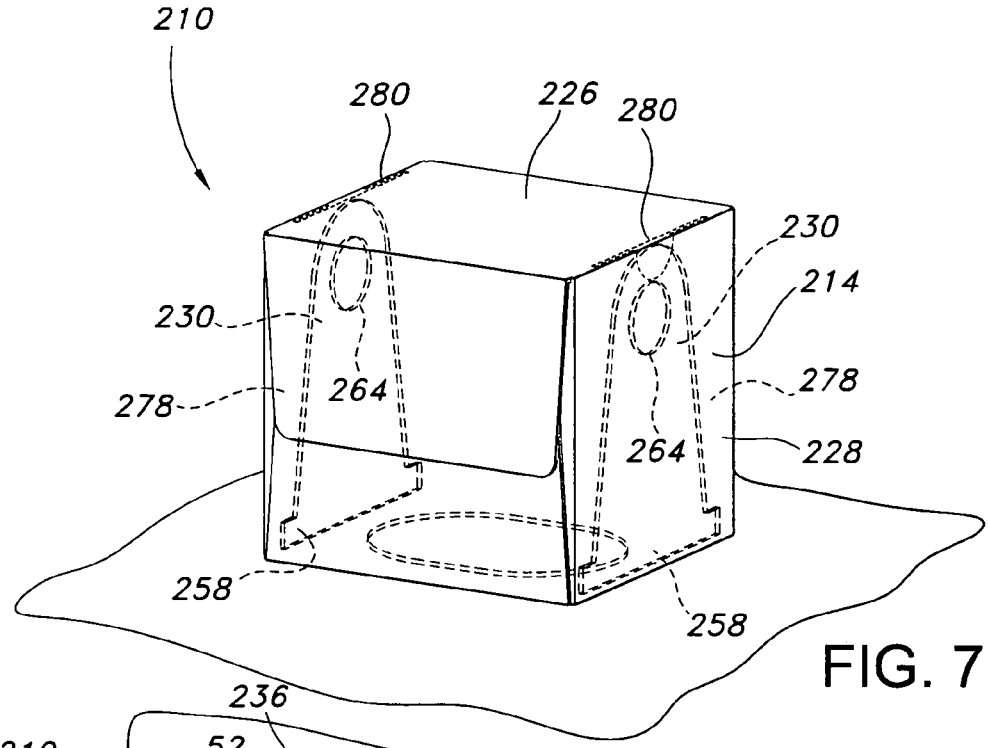
FIG. 7 is a perspective view of yet another embodiment of the dispenser of the present invention, illustrating alternative side arms, the dispenser positioned in its dispensing position on a generally horizontal surface for dispensing dry sheets.
Figure 8:
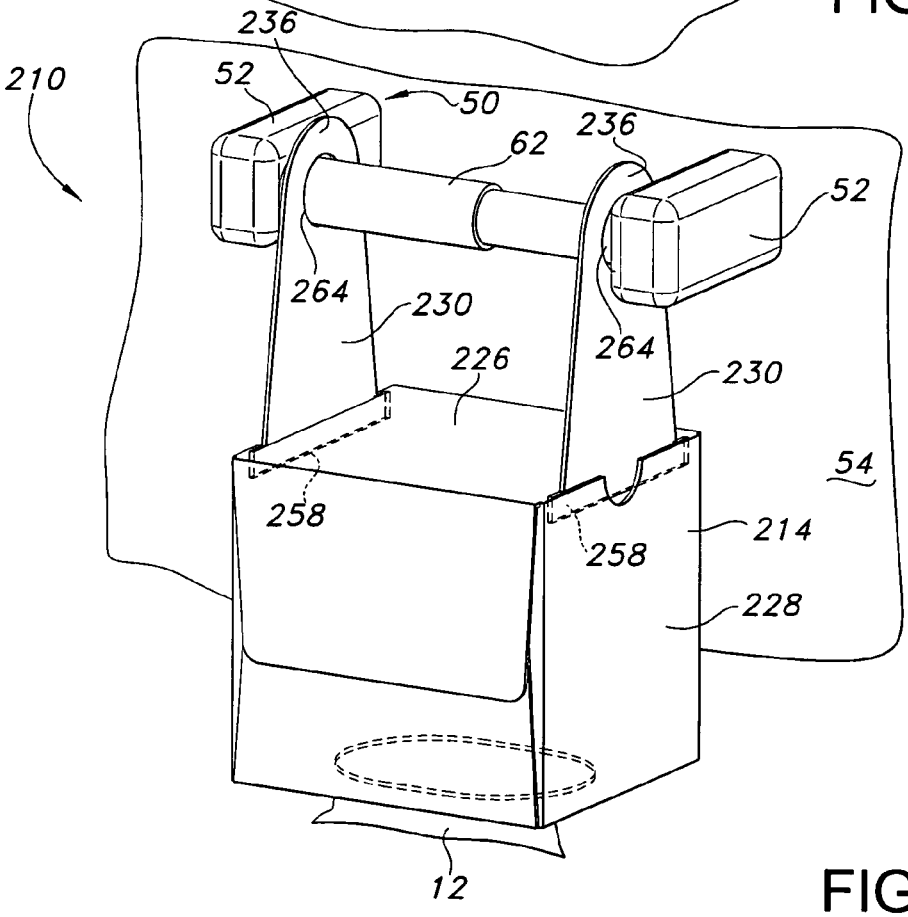
FIG. 8 is a perspective view of the dispenser of FIG. 7, but showing the side arms released and the dispenser positioned in it's dispensing position for dispensing dry sheets from a conventional rolled product fixture.

In yet another embodiment of the present invention, as illustrated in FIGS. 7 and 8, the dispenser 210 and housing 214 are similar to the dispenser 10 and housing 14 shown in FIGS. 1, 2 and 5, and previously described in detail herein. The housing 214, however, has arms 230 which are provided adjacent an inner surface 278 of each sidewall 228. A slot 280 is formed along each sidewall 230, near the junction of the second end 226 and each sidewall 228, to permit withdrawal of each arm 230. The arms 230 are therefore masked or hidden until withdrawn. Each arm 230 has a lower end 258 having a width which is greater than the width of each slot 280; the lower end 258 holds each arm 230 to the housing 214 when the arm 230 is extended. The slot 280 permits a user access to withdraw each arm 230 from the housing 214. Each arm 230 also has an upper free end 236 which has an aperture 264 therein sized to receive a roll mount 62 there through.

The dispenser 210 is desirably positioned in the same position for dispensing as described previously herein to dispense from a horizontal surface, as shown best in FIG. 1. To dispense from a fixture 50, each arm 230 is withdrawn from inside the compartment 16 to extend above the second end 226 of the housing 214, as illustrated in FIG. 8, so that the dispenser 210 is releasably coupled to the fixture 50, as previously described herein. It will be understand that the arms 230 of the present embodiment may be utilized with any embodiment of the invention shown and/or described herein.

In yet another embodiment of the invention, as illustrated in FIGS. 9–11, and 16, the dispenser 310 and housing 314 are similar to the dispenser 10 and housing 14 shown in FIGS. 1, 2 and 5, and previously described in detail herein. The dispenser 310, however, is desirably formed from a resilient material which is formed about the dry sheets 12. Such material is adapted to compress the dry sheets 12. Such compression may be accomplished by shrink wrapping, by vacuum packaging, by mechanically packaging, or by any method or technique known in the art.

Figure 10:
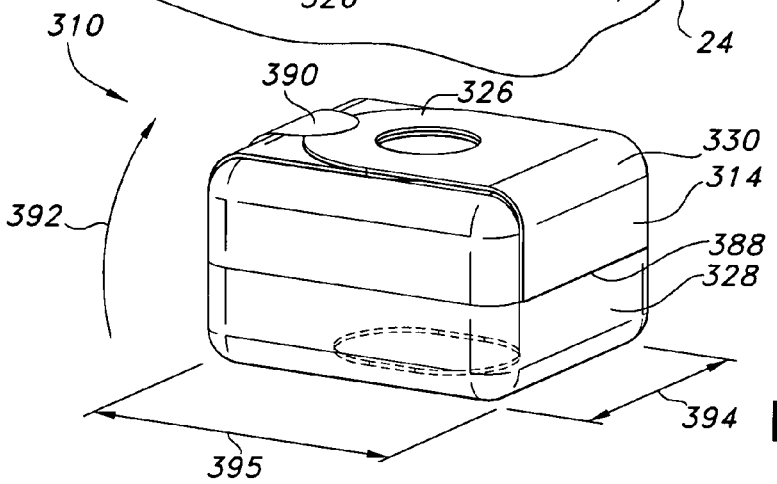
FIG. 10 is a perspective view of the dispenser of FIG. 9, but rotated 180 degrees to show the folded down arms which are provided with the dispenser.

In addition, the housing 314 includes arms 330, which are similar to the arms 30 shown in FIGS. 1 and 2, but are formed along a midline 388 of each sidewall 328 and extend outwardly there-from. In a first dispensing position, the dispenser 310 is provided such that the arms 330 are folded over the second end 326 of the housing 314 when the dispenser 310 is positioned on a generally horizontal surface 24, such as a table top, to dispense dry sheets 12, such as dry sheets for facial use, and so forth. The arms 330 are preferably releasably folded down across the second end 326 and coupled thereto via an adhesive, such as a releasable pressure sensitive adhesive (not shown) and/or an adhesive seal 390, as shown in FIG. 10. In this manner, the arms 330 are masked or hidden against the housing 314 until released for use with the fixture 50.

Figure 9:
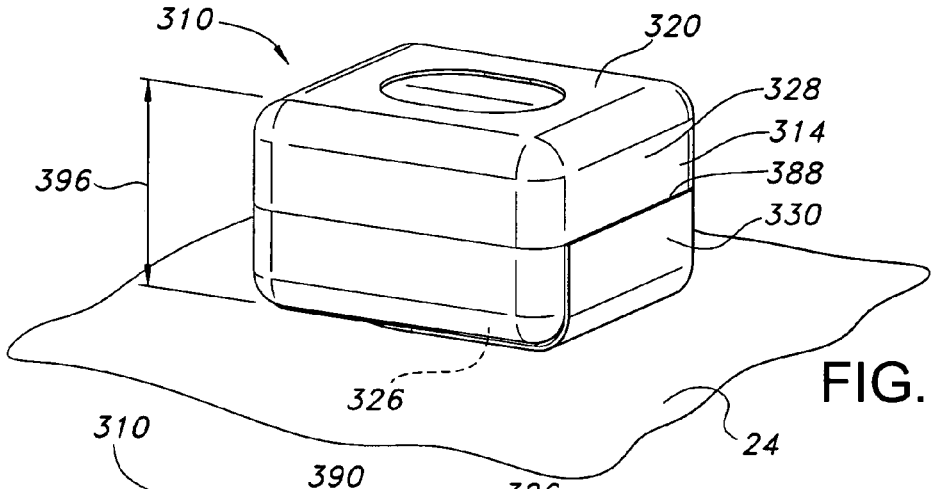
FIG. 9 is a perspective view of a still yet another embodiment of the dispenser of the present invention, illustrating a dispenser positioned in its dispensing position on a generally horizontal surface for dispensing dry sheets.
Figure 11:
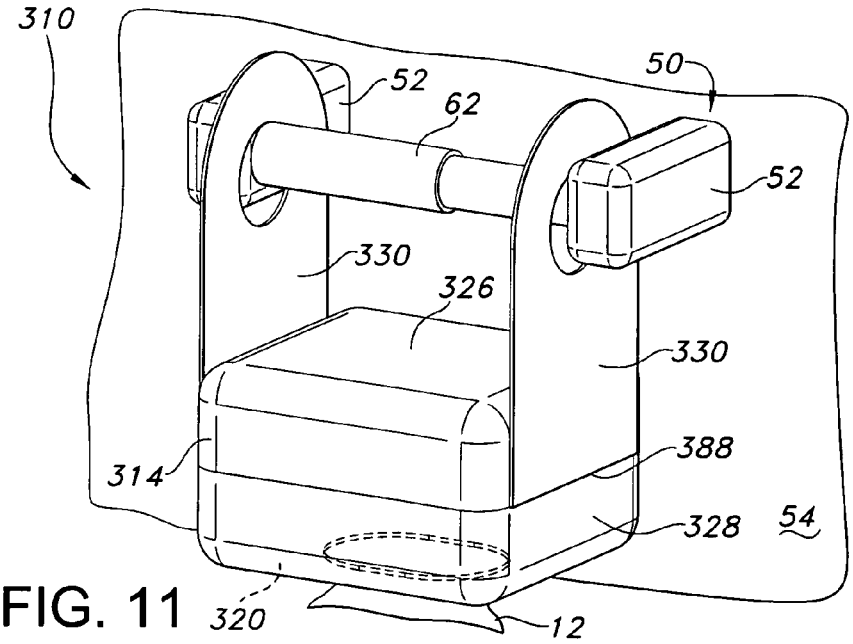
FIG. 11 is a perspective view of the dispenser of FIGS. 9 and 10, but showing the side arms released from the dispenser positioned in it's dispensing position for dispensing dry sheets from a conventional rolled product fixture.

When the dispenser 310 is disposed on a generally horizontal surface 24 to dispense dry sheets 12, the dispenser 310 rests on and is supported on the seal 390 and the second end 326, as illustrated in FIG. 9. When the dispenser is utilized with a conventional rolled product fixture 50, as shown in FIG. 11, the seal 390 is removed (not shown) and the arms 330 are released. The arms 330 may be positioned above the housing 314, as described generally previously herein and as illustrated in FIG. 11, and coupled to a roll mount 62 in any manner disclosed herein. In this position, the dry sheets 12 are dispensed from the first end 320 of the housing 314 which is in a lower or inferior position relative to the second end 326. Alternatively, the dispenser 310 may be turned 180 degrees in a direction 392 prior to being coupled to the roll mount 62, which permits the dry sheets 12 to be dispensed from a position which is higher or superior while the second end 326 is positioned in the lower or inferior position (not shown).

Figure 16:
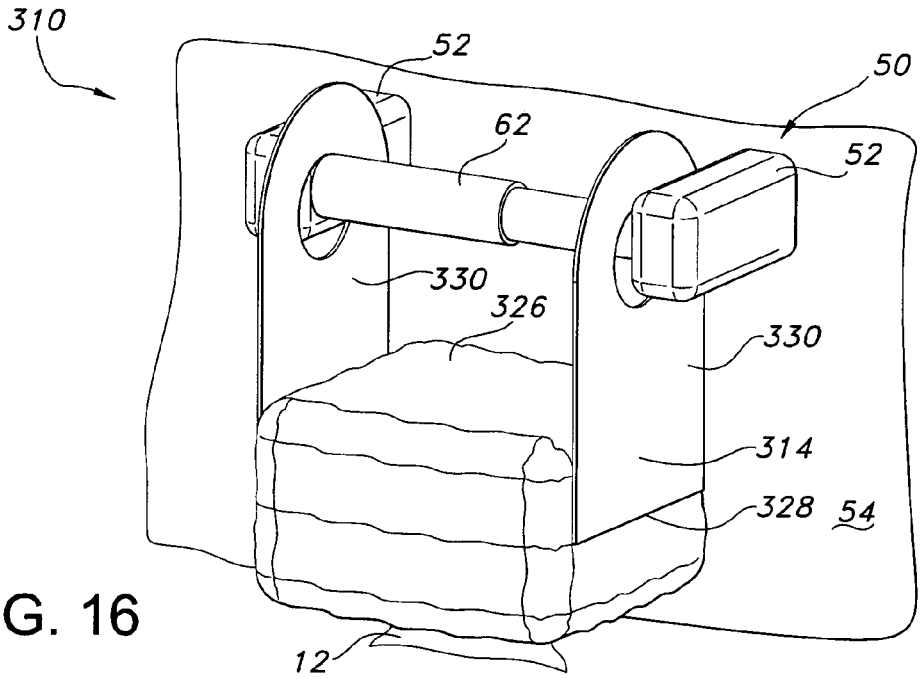
FIG. 16 is a perspective view of the dispenser of FIG. 11, but showing the dispenser decreasing in size as the dry sheets are withdrawn therefrom.

In the present embodiment, the dispenser 310 is preferably constructed as a non-refillable, disposable dispenser constructed from a flexible, resilient material such as, by way of non-limiting example, plastic, polymer film, cellophane, and so forth. Such a dispenser, by example but not by way of limitation, generally conforms to the configuration of the dry sheets 12. As the number of dry sheets 12 in the dispenser 310 decreases with use, the flexible, resilient housing 314 decreases in size and dimension, as shown in FIG. 16. That is, the dispenser 310 may desirably decrease somewhat in the depth dimension 394 (FIG. 10) as well as the width dimension 395 (FIG. 10) and the length dimension 396 (FIG. 9) when the dry sheets 12 becomes depleted in number. It will be appreciated that the dispenser 310 may include any feature or characteristic shown and/or described herein.

In another embodiment of the invention, as illustrated in FIGS. 12–15, the dispenser 410 and the housing 414 are similar to the dispenser 310 and 110 and housing 314 and 114 shown in FIGS. 3–4, 6, 9–11 and 16, and previously described in detail herein. However, the dispenser 410 includes premoistened sheets 111 and dry sheets 12, generally as shown and described by dispenser 110 and housing 114, but the orientation of the premoistened sheets 111 in their container 417 is not parallel to the dry sheets 12. Rather, the orientation of the premoistened sheets 111 is, by way of example but not by way of limitation, perpendicular relative to the dry sheets 12. This orientation permits easy access to both types of sheets 12, 111 on horizontal surface 24 such as dispensing from a table top as well as dispensing from a fixture 50; it is only one, however, of any number of possible configurations of premoistened and dry sheets 111, 12 as described previously herein. Further, the dispenser 410 is formed similarly to dispenser 310 described in detail previously herein.

Figure 12:
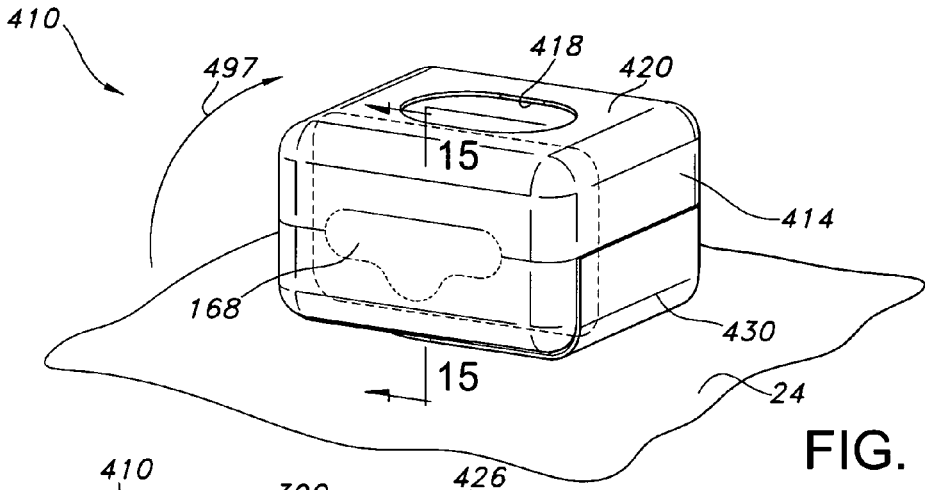
FIG. 12 is a perspective view of another embodiment of the dispenser of the present invention, illustrating a somewhat collapsible dispenser, the dispenser positioned in it's dispensing position on a generally horizontal surface for dispensing dry sheets and premoistened sheets therefrom.
Figure 13:
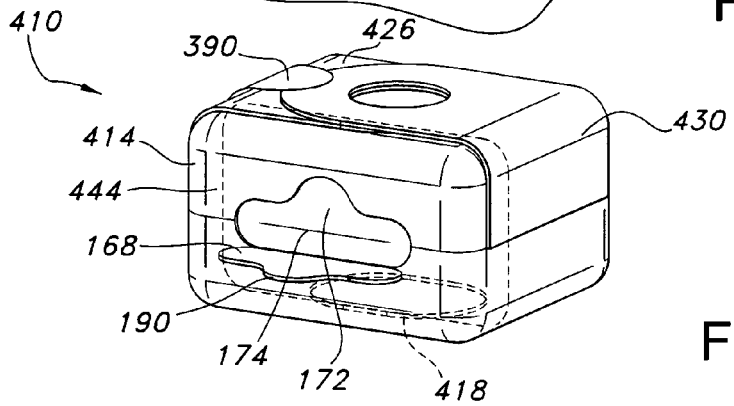
FIG. 13 is a perspective view of the dispenser of FIG. 12, but rotated 180 degrees to show the folded down arms which are provided with the dispenser.

In a first dispensing position, as illustrated in FIG. 12, the first dispensing opening 418 from which dry sheets 12 are withdrawn is provided in the first end 420 which is positioned in a superior or higher position. The second dispensing opening (not shown) which is covered by the resealable cover 168 from which premoistened sheets 111 are withdrawn is provided in a front wall 444 of the dispenser 410 in an inferior or lower (side) position relative to the first dispensing opening 418. It will be appreciated, however, that the dispenser may be rotated in a direction 497 about 90 degrees, with the result being that the premoistened sheets 111 are positioned in a superior or higher position and the dry sheets 12 are positioned in an inferior or lower (side) position.

Figure 14:
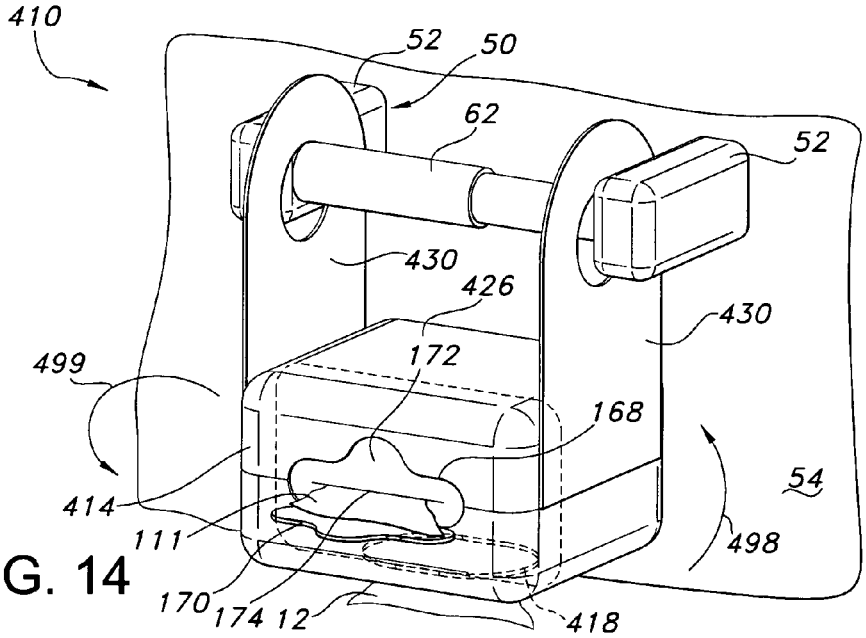
FIG. 14 is a perspective view of the dispenser of FIGS. 12 and 13, but showing the side arms released from the dispenser positioned in it's dispensing position for dispensing dry sheets and premoistened sheets when coupled to a conventional rolled product fixture.
Figure 15:
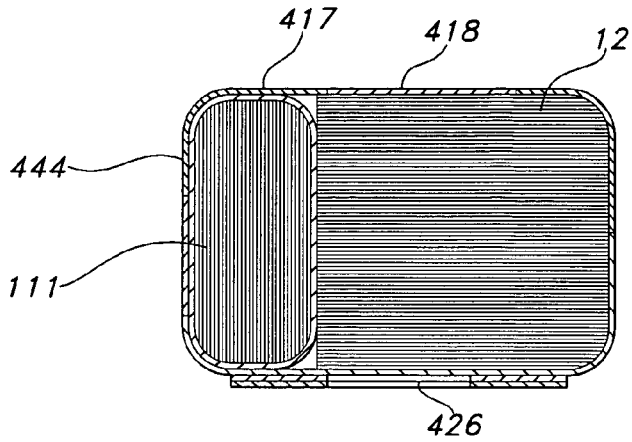
FIG. 15 is a sectional view of FIG. 12 taken along line 15—15.

A seal 390, as described previously, is provided such that the arms 430 are folded over the second end 426 of the dispenser 410. As shown in FIG. 14, the seal 390 is releasably positioned on the arms 430 to hold the arms 430 in a position to permit the dispenser 410 to dispense from a surface 24 without the arms 330 being extended.

When the dispenser 410 is utilized with the fixture 50 as shown in FIG. 14, the seal 390 is removed (not shown) and the arms 430 are released. The arms 430 are positioned above the housing 410, as described previously above and illustrated in FIG. 14, and coupled to roll mount 62. In this position, the dry sheets 12 are dispensed from the first dispensing opening 418 in the first end 420 which is in a lower or inferior position relative to the second end 426, and the premoistened sheets 111 which are dispensed through the resealable cover 168 in the front wall 444, which is in a higher or superior position relative to the first dispensing opening 418 and the dry sheets 12. Alternatively, the dispenser 410 may be released from the fixture 50 and turned around 180 degrees in a direction 498 as well as rotated 180 degrees in a direction 499 before being re-coupled to the roll mount 62. This position permits the dry sheets 12 to be dispensed from the first dispensing opening 418 in the first end 420 which is positioned in a superior position relative to the second end 426. The premoistened sheets 111 are dispensed accessed and dispensed through the resealable cover 168 in the front wall 444 in a position which remains lower or inferior relative to the first end 420 and the dry sheets 12 dispensed therefrom. It will be appreciated that the dispense 410, similar to the dispenser 310 shown in FIG. 16, also collapses somewhat as the dry sheets 12 and the premoistened sheets 111 are withdrawn from the dispenser 410 providing an indication to the user of the lesser amount of sheets 12 remaining in the dispenser 410.

While the present invention has been described in connection with certain preferred embodiments it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A non-refillable dispenser adapted for dispensing from a table top and convertible to dispensing from a conventional rolled product fixture, the non-refillable dispenser comprising:

a housing having a compartment configured to hold sheets therein and a dispensing opening, the housing configured to be positioned on a table top for dispensing sheets therefrom, the housing including connecting means including arms which permit the housing to be coupled to a fixture, the connecting means masked as a portion of the housing and the arms folded down and held against the housing by one of adhesive on the arms, a seal, and a combination thereof when the housing is positioned on a table top for dispensing therefrom, the connecting means readily releasable to permit the housing to be coupled to a fixture in a bathroom.

2. The non-refillable dispenser of claim 1, wherein the connecting means are masked as a portion of the sidewalls when the dispenser is used for dispensing from a table top.

3. The non-refillable dispenser of claim 2, wherein the connecting means are provided by perforated areas in the sidewalls.

4. The non-refillable dispenser of claim 3, wherein the connecting means are released when the perforated areas are disconnected from the sidewalls.

5. The non-refillable dispenser of claim 4, wherein the connecting means are arms having a connected end and a free end having an opening therein sized to receive a roll mount therethrough.

6. The non-refillable dispenser of claim 1, wherein the housing has a width dimension which is less than a width dimension between support arms of a fixture.

7. The non-refillable dispenser of claim 1, wherein the housing is configured to permit dispensing of sheets from an upper end or a lower end when the dispenser is connected to a fixture.

8. The non-refillable dispenser of claim 1, wherein the sheets include dry sheets.

9. The non-refillable dispenser of claim 8, wherein the dry sheets are toilet tissue.

10. The non-refillable dispenser of claim 1, wherein the sheets include dry sheets and premoistened sheets.

11. The non-refillable dispenser of claim 1, wherein the housing includes a resealable cover.

12. The non-refillable dispenser of claim 1, wherein the housing is constructed from paper, paperboard, cardboard, plastic, polymer film, cellophane, and any combination thereof.

13. The non-refillable dispenser of claim 1, wherein the housing is constructed from a resilient material which compresses sheets therein.

14. The non-refillable dispenser of claim 13, wherein the housing decreases in at least one dimension when sheets are depleted from housing.

15. The non-refillable dispenser of claim 1, wherein the arms which are hidden inside of the housing when the housing is positioned on a table top for dispensing therefrom and the arms are withdrawn through slots in the housing to couple to a fixture for dispensing in a bathroom.

16. A dispenser adapted for dispensing from a table top and convertible to dispensing from a conventional rolled product fixture, the non-refillable dispenser comprising:

a housing having a compartment configured to hold sheets therein and a dispensing opening, the housing configured to be positioned on a table top for dispensing sheets therefrom, the housing including arms which permit the housing to be coupled to a fixture, the arms masked as a portion of the housing and the arms folded down and held against the housing by one of adhesive on the arms, a seal, and a combination thereof when the housing is positioned on a table top for dispensing therefrom, the arms readily releasable to permit the housing to be releasably coupled to a fixture in a bathroom.

17. The dispenser of claim 16, wherein the sidewalls of the housing have perforated areas which define at least one arm in each sidewall, the arms released when the perforated areas are disconnected from the sidewalls.

18. The dispenser of claim 17, wherein the arms having a connected end and a free end having an opening therein sized to receive a roll mount therethrough.

19. The dispenser of claim 16, wherein the housing has a width dimension which is less than a width dimension between support arms of a fixture.

20. The dispenser of claim 16, wherein the housing is configured to permit dispensing of sheets from an upper end or a lower end when the dispenser is connected to a fixture.

21. The dispenser of claim 16, wherein the sheets include dry sheets which are toilet tissue.

22. The dispenser of claim 16, wherein the sheets include dry sheets and premoistened sheets.

23. The dispenser of claim 16, wherein the housing includes a resealable cover.

24. The dispenser of claim 16, wherein the housing is constructed from paper, paperboard, cardboard, plastic, polymer film, cellophane, and any combination thereof.

25. The dispenser of claim 16, wherein the housing is constructed from a resilient material which compresses sheets therein, the housing decreased in at least one dimension when sheets are depleted therefrom.

26. The dispenser of claim 16, wherein the arms which are hidden inside of the housing when the housing is positioned on a table top for dispensing therefrom and the arms are withdrawn through slots in the housing to couple to a fixture for dispensing in a bathroom.

27. A dispenser adapted for dispensing from a table top and convertible to dispensing from a conventional rolled product fixture in a bathroom, the non-refillable dispenser comprising:

a housing having a compartment configured to hold dry sheets and premoistened sheets therein and dispensing openings positioned to permit the dry sheets and the premoistened sheets to be dispensed therefrom, the housing configured to be positioned on a table top for dispensing sheets therefrom, the housing including arms which permit the housing to be coupled to a fixture, the arms masked as a portion of the housing and the arms folded down and held against the housing by one of adhesive on the arms, a seal, and a combination thereof when the housing is positioned on a table top for dispensing therefrom, the arms readily releasable and the housing configured to dispense from an upper end or a lower end when the housing is coupled to a fixture in a bathroom.

28. The dispenser of claim 27, wherein the sidewalls of the housing have perforated areas which define at least one arm in each sidewall, the arms released when the perforated areas are disconnected from the sidewalls.

29. The dispenser of claim 28, wherein the arms having a connected end and a free end having an opening therein sized to receive a roll mount therethrough.

30. The dispenser of claim 27, wherein the housing has a width dimension which is less than a width dimension between support arms of a fixture.

31. The dispenser of claim 27, wherein the dry sheets include toilet tissue.

32. The dispenser of claim 27, wherein the housing includes a resealable cover.

33. The dispenser of claim 27, wherein the housing is constructed from paper, paperboard, cardboard, plastic, polymer film, cellophane, and any combination thereof.

34. The dispenser of claim 27, wherein the housing is constructed from a resilient material which compresses sheets therein, the housing decreased in at least one dimension when sheets are depleted therefrom.

35. The dispenser of claim 27, wherein the arms which are hidden inside of the housing when the housing is positioned on a table top for dispensing therefrom and the arms are withdrawn through slots in the housing to couple to a fixture for dispensing in a bathroom.

* * * * *